US009410324B2

(12) United States Patent
Chabowski

(10) Patent No.: US 9,410,324 B2
(45) Date of Patent: Aug. 9, 2016

(54) METHOD OF ROOF COVERING WITH ROOF COVERING ELEMENTS (TILE-LIKE SHEETS)

(71) Applicant: Bogdan Wiecek BUDMAT, Plock (PL)

(72) Inventor: Andrzej Chabowski, Plock (PL)

(73) Assignee: BOGDAN WIECEK BUDMAT, Plock (PL)

( * ) Notice: Subject to any disclaimer, the term of this patent is extended or adjusted under 35 U.S.C. 154(b) by 0 days.

(21) Appl. No.: 14/432,746

(22) PCT Filed: Jul. 29, 2013

(86) PCT No.: PCT/PL2013/000099
§ 371 (c)(1),
(2) Date: Mar. 31, 2015

(87) PCT Pub. No.: WO2014/171845
PCT Pub. Date: Oct. 23, 2014

(65) Prior Publication Data

US 2015/0275519 A1 Oct. 1, 2015

(30) Foreign Application Priority Data

Apr. 15, 2013 (PL) ..... 403552

(51) Int. Cl.
*E04D 1/34* (2006.01)
*E04D 3/36* (2006.01)
(Continued)

(52) U.S. Cl.
CPC .. *E04D 1/34* (2013.01); *E04D 3/30* (2013.01); *E04D 3/365* (2013.01); *E04D 3/3606* (2013.01); *E04D 12/004* (2013.01);
(Continued)

(58) Field of Classification Search
CPC . E04D 1/34; E04D 12/004; E04D 2001/3426; E04D 2001/3408; E04D 2001/3452; E04D 2001/3476; E04D 2001/3482; E04D 3/36; E04D 3/361; E04D 3/365
USPC ..... 52/747.1, 747.11, 748.1, 520, 532, 543, 52/551, 536, 537, 478
See application file for complete search history.

(56) References Cited

U.S. PATENT DOCUMENTS 37,450 A * 1/1863 Lasserre ..... 52/521
121,438 A * 11/1871 Wands ..... 52/547
(Continued)

FOREIGN PATENT DOCUMENTS

CA 2868563 A1 10/2013
CA 2868566 9/2014
(Continued)

OTHER PUBLICATIONS

International Search Report of International Application No. PCT/PL2013/000099 mailed Dec. 18, 2013.
(Continued)

*Primary Examiner* — Robert Canfield
(74) *Attorney, Agent, or Firm* — Roberts Mlotkowski Safran Cole & Calderon, P.C.

(57) ABSTRACT

A method for covering a roof with tile-like roof covering elements each having assembling holes at the corners, wherein the edges of the roof covering elements are overlapped such that the assembling holes align and are mounted together with screws. Additionally, one or more of the roof covering elements can be mounted to at least one roof batten with a cramp and screw.

4 Claims, 3 Drawing Sheets

(51) Int. Cl.

| | |
|---|---|
| ***E04D 3/30*** | (2006.01) |
| ***E04D 3/365*** | (2006.01) |
| ***E04D 12/00*** | (2006.01) |

(52) U.S. Cl.

CPC ..... *E04D 2001/3426* (2013.01); *E04D 2001/3476* (2013.01); *E04D 2001/3482* (2013.01)

(56) References Cited

U.S. PATENT DOCUMENTS

| | | | | |
|---|---|---|---|---|
| 737,078 | A * | 8/1903 | Chapman | 114/84 |
| 805,884 | A * | 11/1905 | Satterlee | 52/537 |
| 1,386,130 | A * | 8/1921 | Marks et al. | 52/394 |
| 1,491,015 | A * | 4/1924 | McFarland | 52/105 |
| 1,658,591 | A * | 2/1928 | Dorn | 52/537 |
| 1,729,946 | A * | 10/1929 | Kuehn | 52/478 |
| 1,816,439 | A * | 7/1931 | Masters | 52/544 |
| 1,913,342 | A * | 6/1933 | Schaffert | 52/588.1 |
| 1,914,876 | A * | 6/1933 | Workman | 52/522 |
| 1,955,699 | A * | 4/1934 | Moffit | 52/546 |
| 2,076,989 | A * | 4/1937 | Andres et al. | 52/537 |
| 2,424,410 | A * | 7/1947 | Miles | 52/537 |
| 2,486,168 | A * | 10/1949 | Jurasevich | 52/521 |
| 2,685,852 | A * | 8/1954 | Godel | 52/16 |
| 2,737,267 | A * | 3/1956 | Koch | 52/478 |
| 3,269,075 | A * | 8/1966 | Cosden et al. | 52/522 |
| 3,754,366 | A * | 8/1973 | Jansson et al. | 52/535 |
| 3,760,545 | A | 9/1973 | Pearse et al. | |
| 3,897,667 | A * | 8/1975 | Turek | 52/546 |
| 4,001,997 | A | 1/1977 | Saltzman | |
| 4,102,106 | A | 7/1978 | Golder et al. | |
| 4,133,161 | A * | 1/1979 | Lester | 52/748.1 |
| 4,178,731 | A | 12/1979 | Petersson | |
| 4,262,462 | A * | 4/1981 | Melbye | 52/98 |
| 4,554,773 | A * | 11/1985 | Conley | 52/521 |
| 4,592,185 | A | 6/1986 | Lynch et al. | |
| 4,598,522 | A | 7/1986 | Hoofe | |
| 4,616,465 | A * | 10/1986 | Byers et al. | 52/745.01 |
| 4,617,773 | A * | 10/1986 | Studwell | 52/537 |
| 5,752,355 | A * | 5/1998 | Sahramaa | 52/539 |
| 5,878,543 | A | 3/1999 | Mowery | |
| 6,269,604 | B1 * | 8/2001 | Pedersen | 52/537 |
| RE38,210 | E * | 8/2003 | Plath et al. | 52/533 |
| 7,316,099 | B2 * | 1/2008 | Faulkner et al. | 52/408 |
| 7,690,169 | B2 | 4/2010 | Saarenko et al. | |
| 7,980,036 | B2 * | 7/2011 | Takayasu et al. | 52/506.01 |
| 8,291,664 | B2 * | 10/2012 | Hanig | 52/464 |
| 2005/0102930 | A1 | 5/2005 | Saarenko et al. | |
| 2007/0144097 | A1 * | 6/2007 | Saarenko et al. | 52/539 |
| 2010/0132275 | A1 | 6/2010 | Stanger | |
| 2011/0146199 | A1 * | 6/2011 | Ferrante et al. | 52/745.06 |
| 2011/0154767 | A1 * | 6/2011 | Perttula et al. | 52/518 |
| 2015/0113902 | A1 * | 4/2015 | Chabowski | 52/519 |
| 2015/0361667 | A1 | 12/2015 | Chabowski | |

FOREIGN PATENT DOCUMENTS

| | | | |
|---|---|---|---|
| CA | 2870817 | A1 | 10/2014 |
| DE | 2157284 | A1 | 5/1972 |
| EA | 201401301 | A1 | 3/2015 |
| EA | 201401131 | A1 | 6/2015 |
| EA | 201401302 | A1 | 6/2015 |
| EP | 2839090 | A1 | 2/2015 |
| FR | 2824856 | | 11/2002 |
| GB | 203132 | A | 9/1923 |
| JP | 11124964 | | 5/1999 |
| NL | 7712976 | | 9/1978 |
| PL | 339424 | A1 | 12/2000 |
| PL | 206210 | B1 | 12/2004 |
| PL | 379919 | | 12/2007 |
| PL | 396691 | | 10/2011 |
| PL | 398857 | | 10/2013 |
| PL | 403087 | A1 | 9/2014 |
| PL | 403552 | A1 | 10/2014 |
| WO | 99/16985 | A1 | 4/1999 |
| WO | 01/11160 | A1 | 2/2001 |
| WO | 2006018472 | A1 | 2/2006 |
| WO | 2009056683 | | 5/2009 |
| WO | 2013157968 | A1 | 10/2013 |
| WO | 2014/142690 | A1 | 9/2014 |
| WO | 2014171845 | A1 | 10/2014 |

OTHER PUBLICATIONS

Notice of Allowance for U.S. Appl. No. 14/394,612 dated Jun. 10, 2015; 5 Pages.

International Search Report of International Application No. PCT/PL2013/000050 mailed Oct. 21, 2014.

International Search Report of International Application No. PCT/PL2014/000021 mailed Jun. 30, 2014.

International Preliminary Report on Patentability of PCT/PL2013/000050 dated Oct. 21, 2014.

International Preliminary Report on Patentability of PCT/PL2013/000099 dated Oct. 20, 2015.

International Preliminary Report on Patentability of PCT/PL2014/000021 dated Sep. 15, 2015.

* cited by examiner

METHOD OF ROOF COVERING WITH ROOF COVERING ELEMENTS (TILE-LIKE SHEETS)

The present invention relates to a method of a roof covering with roof covering elements (tile-like sheets).

A roof cladding element and method for manufacturing roof cladding elements is known from the US patent description no. U.S. Pat. No. 7,690,169 B2. The roof cladding element has been manufactured of profiled plate material. Such manufactured elements are adjacently and in succession mountable such that the edges of a roof cladding element will be placed a distance overlapping with the edges of adjacent roof cladding elements. At least one corner of a roof cladding material has a recess reaching partly lower than the lower surface of the element.

A roof cladding element with a hidden fastening, in which a lower transversal step has got a fastening nest adjusted to a Z-shaped recess of the upper transversal step of an adjacent roof cladding element placed over the previous one, is known from the international patent application no. WO2006018472A1.

From Polish patent description no. PL206210 there is also known a fastening device comprising a strip member of comparatively short length and a securing means for securing to the roof covering free edge of a manually deformable flashing skirt characterized by the strip member at one end is secured to the roof covering with the securing means, while the other end is pressed down the free edge of the flashing skirt against the roof covering.

There is known from the Polish patent application no. P403087 a roof covering element (tile-like sheet) equipped with a cramp, characterized by that a plane of the roof covering element endings at wave-like embossing of the surface of the upper edge has got at least one incision, preferably done in a part without assembling hole and preferably of rectangle shape, in which there is applied the cramp. Incision width is bigger than cramp width.

SUMMARY

The present invention is directed to a method for covering a roof with tile-like roof covering elements each having upper, lower, left and right edges and upper left, lower left, upper right and lower right corners adjoining the edges, and upper left, upper right, lower left and lower right assembling holes at each corner, wherein each roof covering element has a lower transverse step with sunken embossing interlocking with a bend of an upper transverse step of an adjacent roof covering element, comprising fastening the first roof covering element to a roof batten with at least one screw; covering the left edge of a first roof covering element with the right edge of a second roof covering element, and mounting the first and second roof covering elements together with a screw placed through the lower right assembling hole of the second roof covering element and the aligned lower left assembling hole of the first roof covering element; fastening the second roof covering element to a roof batten with at least one screw; covering the upper edge of the first roof covering element with the lower edge of a third roof covering element, and mounting the first and third roof covering elements together with a screw placed through the lower right assembling hole of the third roof covering element and the aligned upper right assembling hole of the first roof covering element, wherein at the same time, the lower left assembling hole of the third roof covering element aligns with the upper right assembling hole of the second roof covering element; covering the left edge of the third roof covering element with the right edge of a fourth roof covering element, and mounting the third and fourth roof covering elements together with a screw placed through the upper left assembling hole of the third roof covering element and the aligned upper right assembling hole of the fourth roof covering element; mounting the fourth and the second roof covering elements with a screw applied through a middle lower assembling hole of the fourth roof covering element and through a middle upper assembling hole of the second roof covering element; and wherein a junction comprised of the adjoining corners of the four roof covering elements is connected with a screw applied through the lower right assembling hole of the fourth roof covering element, the lower left assembling hole of the third roof covering element, the upper right assembling hole of the second roof covering element and the upper left assembling hole of the first roof covering element.

BRIEF DESCRIPTION OF THE DRAWINGS

The subject of the invention is presented in exemplary embodiments in drawings on which.

DETAILED DESCRIPTION

Figure 1A:
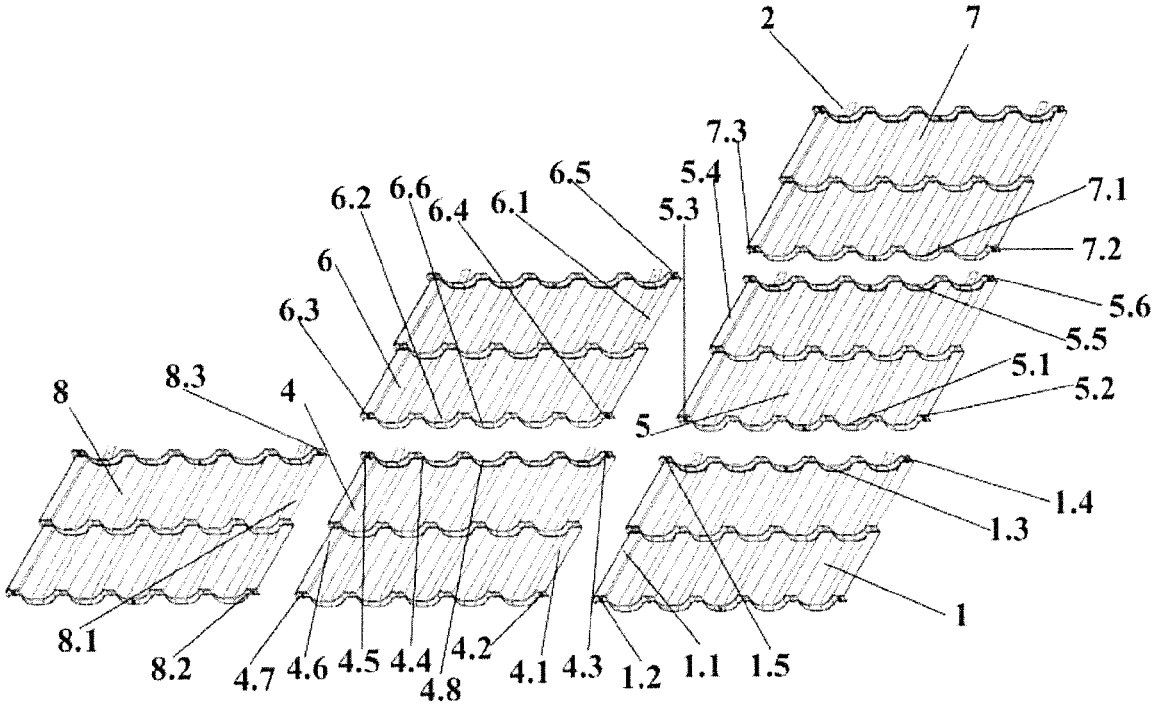
FIG. 1A illustrates an axonometric view of separate mounted sheets.

The roof covering elements (tile-like sheets) useful with the present invention can be prefabricated, having assembling embossments and assembling holes, and exploiting embossments at a corner of the roof covering element. The method of covering a roof according to this invention is characterized in that the left edge of an initial sheet, stabilized by fastening with at least one screw to a roof batten, is covered by the right edge of the second sheet, and the sheets are mounted by a screw placed through a right lower assembling hole of the second sheet and a left lower assembling hole of the initial sheet. Then, the second sheet is stabilized by mounting with at least one screw to a roof batten. Thereafter, the lower edge of the third sheet is put on the upper edge the initial sheet, and these sheets are mounted by a screw placed through the right lower assembling hole of the third sheet and the right upper assembling hole of the initial sheet. At the same time, the left lower assembling hole of the third sheet aligns with the right upper assembling hole of the second sheet. Then, the right edge of the fourth sheet is put onto the left edge of the third sheet, whilst the lower edge of the fourth sheet is placed onto the upper edge of the second sheet. The fourth and the second sheets are mounted by a screw applied through a middle lower assembling hole of the fourth sheet and through, preferably, a middle upper assembling hole of the second sheet. Next, a junction comprised of corners of four sheets is mounted with a screw applied through the aligned right lower assembling hole of the fourth sheet, the left lower assembling hole of the third sheet, the right upper assembling hole of the second sheet and through the left upper assembling hole of the initial sheet. In each case, a bend—preferably straight—of the lower edge end of a sheet put onto a sheet to be covered, is placed in a semicircular deflection of the sheet to be covered.

The lower edge of a following sheet is placed onto the upper edge of the third sheet, and these sheets are mounted with a screw applied through the right lower assembling hole of the following sheet and through the right upper assembling hole of the third sheet.

Simultaneously, the left lower assembling hole of the following sheet appears over the right upper assembling hole of the fourth sheet. In each case, a bend—preferably straight—of the lower edge end of the following sheet is placed in a semicircular deflection of the third sheet to be covered. Further mounting of sheets is according to the aforementioned assembling procedure, in which the following sheet is to be considered as the third one.

The right edge of a next sheet is placed onto the left edge of the second sheet and these sheets are mounted with a screw applied through the right lower assembling hole of the next sheet and through the left lower assembling hole of the second sheet. Simultaneously, the right upper assembling hole of the next sheet aligns with the left upper assembling hole of the second sheet and under the left lower assembling hole of the fourth sheet. Further mounting of sheets is according to the aforementioned assembling procedure, in which the next sheet is to be considered as the second one.

In another version of the invention, an initial sheet or the second sheet or the third sheet or the fourth sheet or the following sheet or the next sheet is fixed to a roof batten with at least one cramp.

In each case, the bent edge of a cramp is placed in a semicircular deflection of the initial sheet or in a semicircular deflection of the second sheet or in a semicircular deflection of the third sheet or in a semicircular deflection of the fourth sheet or in a semicircular deflection of the following sheet or in a semicircular deflection of the next sheet.

The method of roof covering with roof covering elements (tile-like sheets) according to this invention provides ideal mounting of all sheets by easy and quick assembly. There is no need for extra fitting of sheets, as every sheet can be applied in any place. The roof covering can be performed in any direction: upwards and to left or right from the bottom, or downwards and to left or right from the top. If needed, the method of a roof covering according to this invention enables easy replacement of a damaged part of a roof by dismantling only the sheets nearest to the damaged piece.

The roof done according to this invention enables free dripping of condensed water and free air circulation, which results in lower risk of corrosion.

Figure 1B:
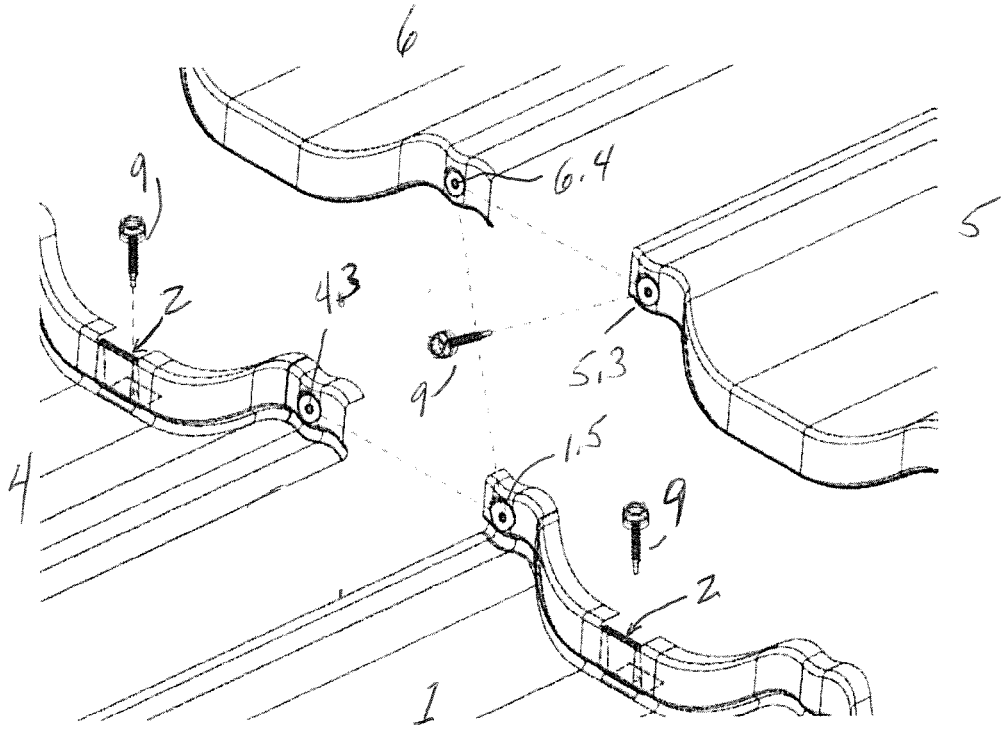
FIG. 1B is a detailed view of the junction between corners of four mounted sheets.
Figure 2:
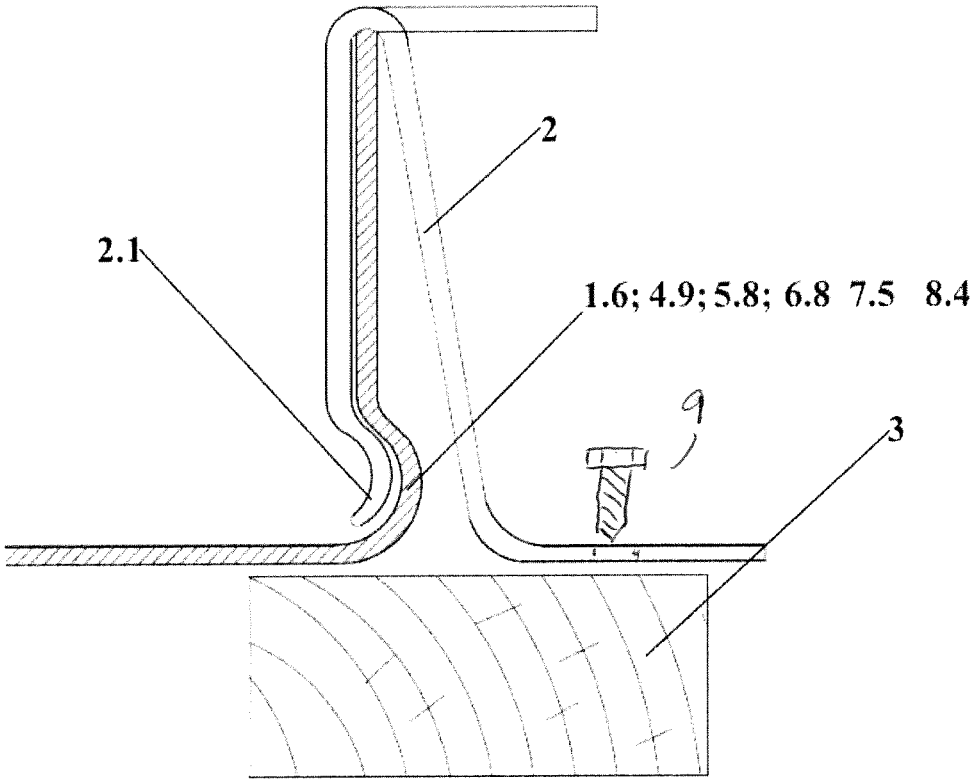
FIG. 2 shows cross-section of mounting with a cramp.
Figure 3:
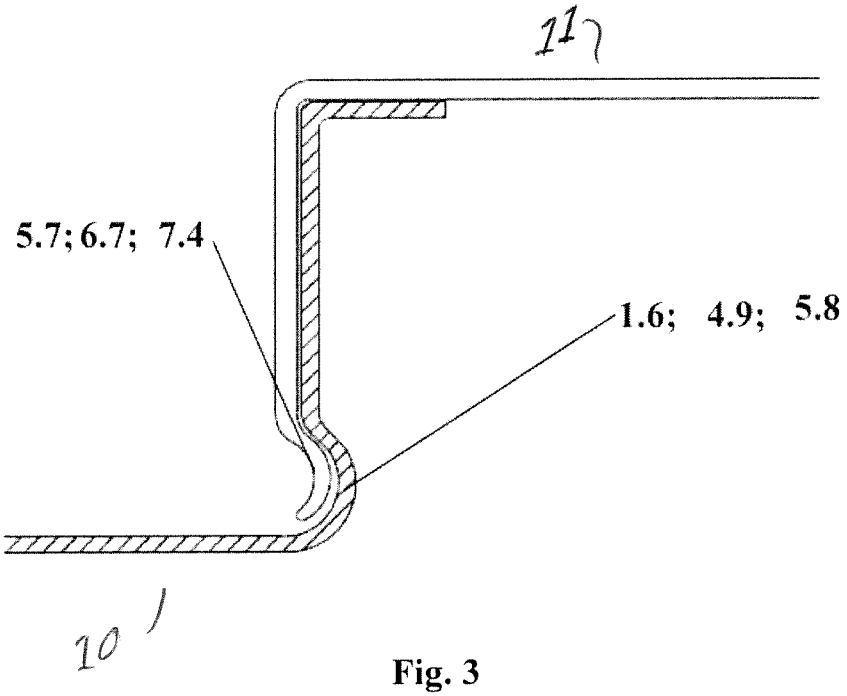
FIG. 3 presents cross-section of a place where edges of following sheets are mounted.

Referring now to the figures, the method of roof covering with roof covering elements (tile-like sheets), wherein each roof covering element has a lower transverse step 10 with sunken embossing 1.6 interlocking with a bend 5.7 of an upper transverse step 11 of an adjacent roof covering element (FIG. 3), according to this invention is characterized by the left edge 1.1 of an initial sheet 1, which is stabilized by fastening it with at least one screw 9 to a roof batten 3 (FIG. 2), is covered by the right edge 4.1 of the second sheet 4. The sheets are mounted together with a screw 9 placed through the right lower assembling hole 4.2 of the second sheet 4 and the left lower assembling hole 1.2 of the initial sheet. The second sheet 4 is stabilized by mounting it a to a roof batten 3, such as with at least one screw 9 through a cramp 2 and into the roof batten 3. Thereafter, the lower edge 5.1 of the third sheet 5 is put on the upper edge 1.3 the initial sheet 1, and these sheets are mounted by a screw placed through the right lower assembling hole 5.2 of the third sheet 5 and the right upper assembling hole 1.4 of the initial sheet 1. At the same time, the left lower assembling hole 5.3 of the third sheet 5 aligns with the right upper assembling hole 4.3 of the second sheet 4. Then, the right edge 6.1 of the fourth sheet 6 is put onto the left edge 5.4 of the third sheet 5, whilst the lower edge 6.2 of the fourth sheet 6 is placed onto the upper edge 4.4 of the second sheet 4, and the fourth 6 and the second 4 sheets are mounted by a screw applied through, preferably, the middle lower assembling hole 6.6 of the fourth sheet 6 and through the middle upper assembling hole 4.8 of the second sheet 4. Next, a junction comprised of corners of four sheets (FIG. 1B) is mounted with a screw 9 applied through the aligned right lower assembling hole 6.4 of the fourth sheet 6, the left lower assembling hole 5.3 of the third sheet 5, the right upper assembling hole 4.3 of the second sheet 4 and through the left upper assembling hole 1.5 of the initial sheet 1. In each case, a bend 5.7 or 6.7—preferably straight—of the lower edge end 5.1 or 6.2 of a sheet put onto a sheet to be covered, is placed in a semicircular deflection 1.6 or 4.9 of the sheet to be covered. The lower edge 7.1 of a following sheet 7 is placed onto the upper edge 5.5 of the third sheet 5, and these sheets are mounted with a screw applied through the right lower assembling hole 7.2 of the following sheet 7 and through the right upper assembling hole 5.6 of the third sheet 5. Simultaneously, the left lower assembling hole 7.3 of the following sheet 7 aligns with the right upper assembling hole 6.5 of the fourth sheet 6. In each case, a bend 7.4—preferably straight—of the lower edge end 7.1 of the following sheet 7 is placed in a semicircular deflection 5.8 of the third sheet 5 to be covered. Further mounting of sheets is according to the aforementioned assembling procedure, in which the following sheet 7 is to be considered as the third one 5. The right edge 8.1 of a next sheet 8 is placed onto the left edge 4.6 of the second sheet 4 and these sheets are mounted with a screw applied through the right lower assembling hole 8.2 of the next sheet 8 and through the left lower assembling hole 4.7 of the second sheet 4. Simultaneously, the right upper assembling hole 8.3 of the next sheet 8 appears over the left upper assembling hole 4.5 of the second sheet 4 and under the left lower assembling hole 6.3 of the fourth sheet 6. Further mounting of sheets is according to the aforementioned assembling procedure, in which the next sheet 8 is to be considered as the second one 4.

In another version of the invention, an initial sheet 1 or the second sheet 4 or the third sheet 5 or the fourth sheet 6 or the following sheet 7 or the next sheet 8 is fixed with at least one cramp 2 with a screw 9 to a roof batten 3.

Every time the bent edge 2.1 of a cramp 2 is placed in a semicircular deflection 1.6 of the initial sheet 1 or in a semicircular deflection 4.9 of the second sheet 4 or in a semicircular deflection 5.8 of the third sheet 5 or in a semicircular deflection 6.8 of the fourth sheet 6 or in a semicircular deflection 7.5 of the following sheet 7 or in a semicircular deflection 8.4 of the next sheet 8.

A LIST OF SYMBOLS ON DRAWINGS

1. initial sheet
1.1. left edge of the initial sheet
1.2. left lower assembling hole of the initial sheet
1.3. upper edge of the initial sheet
1.4. right upper assembling hole of the initial sheet
1.5. left upper assembling hole of the initial sheet
1.6. semicircular deflection (sunken embossing) of the initial sheet
2. cramp
2.1. bent edge
3. roof batten
4. the second sheet
4.1. left edge of the second sheet
4.2. right lower assembling hole of the second sheet
4.3. right upper assembling hole of the second sheet
4.4. upper edge of the second sheet

4.5. left upper assembling hole of the second sheet
4.6. left edge of the second sheet
4.7. left lower assembling hole of the second sheet
4.8. middle upper assembling hole
4.9. semicircular deflection of the second sheet
5. the third sheet
5.1. lower edge of the third sheet
5.2. right lower assembling hole of the third sheet
5.3 left lower assembling hole of the third sheet
5.4 left edge of the third sheet
5.5. upper edge of the third sheet
5.6. right upper assembling hole of the third sheet
5.7. straight bend of the third sheet
5.8. semicircular deflection of the third sheet
6. the fourth sheet
6.1. right edge of the fourth sheet
6.2. lower edge of the fourth sheet
6.3. left lower assembling hole of the fourth sheet
6.4. right lower assembling hole of the fourth sheet
6.5. right upper assembling hole of the fourth sheet
6.6. middle lower assembling hole of the fourth sheet
6.7. straight bend of the fourth sheet
6.8. semicircular deflection of the fourth sheet
7. following sheet
7.1. lower edge of the following sheet
7.2. right lower assembling hole of the following sheet
7.3. left lower assembling hole of the following sheet
7.4. straight bend of the following sheet
7.5. semicircular deflection of the following sheet
8. next sheet
8.1. right edge of the next sheet
8.2. right lower assembling hole of the next sheet
8.3. right upper assembling hole of the next sheet
8.4. semicircular deflection of the next sheet
9. screw
10. lower transverse step
11. upper transverse step

The invention claimed is:

1. A method for covering a roof with tile-like roof covering elements each having upper, lower, left and right edges and upper left, lower left, upper right and lower right corners adjoining the edges, and upper left, upper right, lower left and lower right assembling holes at each corner, wherein each roof covering element has a lower transverse step with sunken embossing interlocking with a bend of an upper transverse step of an adjacent roof covering element, comprising:

fastening a first roof covering element to a roof batten with at least one screw;

covering the left edge of the first roof covering element with the right edge of a second roof covering element, and mounting the first and second roof covering elements together with a screw placed through the lower right assembling hole of the second roof covering element and the aligned lower left assembling hole of the first roof covering element;

fastening the second roof covering element to a roof batten with at least one screw;

covering the upper edge of the first roof covering element with the lower edge of a third roof covering element, and mounting the first and third roof covering elements together with a screw placed through the lower right assembling hole of the third roof covering element and the aligned upper right assembling hole of the first roof covering element, wherein at the same time, the lower left assembling hole of the third roof covering element aligns with the upper right assembling hole of the second roof covering element;

covering the left edge of the third roof covering element with the right edge of a fourth roof covering element, and mounting the third and fourth roof covering elements together with a screw placed through the upper left assembling hole of the third roof covering element and the aligned upper right assembling hole of the fourth roof covering element;

mounting the fourth and the second roof covering elements with a screw applied through a middle lower assembling hole of the fourth roof covering element and through a middle upper assembling hole of the second roof covering element; and wherein a junction comprised of the adjoining corners of the four roof covering elements is connected with a screw applied through the aligned lower right assembling hole of the fourth roof covering element, the lower left assembling hole of the third roof covering element, the upper right assembling hole of the second roof covering element and the upper left assembling hole of the first roof covering element.

2. The method according to claim 1, further comprising covering the upper edge of the third roof covering element with the lower edge of another roof covering element and mounting these roof covering elements together with a screw applied through the aligned assembling holes of the elements.

3. The method according to claim 1, wherein the roof covering elements are fixed to a roof batten with at least one cramp.

4. The method of claim 3, wherein the cramp has a bent edge which is placed in a semicircular deflection of the roof forming element.

* * * * *